US006142880A

United States Patent [19]

Titus

[11] Patent Number: 6,142,880

[45] Date of Patent: Nov. 7, 2000

[54] METHOD OF PLAYING A BOWLING GAME

[76] Inventor: Thomas A. Titus, 1075 River Ave., Flemington, N.J. 08822

[21] Appl. No.: 09/256,822

[22] Filed: Feb. 24, 1999

[51] Int. Cl.[7] ..... A63D 5/00

[52] U.S. Cl. ..... 473/54

[58] Field of Search ..... 473/54, 70, 71

[56] References Cited

U.S. PATENT DOCUMENTS 4,597,575 7/1986 Kosof ..... 273/37
4,817,947 4/1989 Gautraud ..... 273/37
4,884,806 12/1989 Brim ..... 273/37
5,582,549 12/1996 File ..... 473/54

*Primary Examiner*—William M. Pierce
*Attorney, Agent, or Firm*—Henderson & Sturm LLP

[57] ABSTRACT

A method of playing a bowling game wherein players are allowed at least one ball in each of twelve frames. If the player has a predetermined minimum pin count with the first ball in a frame, they are awarded another ball to complete the spare. If the player has fewer than the predetermined minimum pin count with the first ball in a frame, the pin count is scored and the player goes to the next frame. This method of scoring eliminates the unfair advantage of scoring consecutive strikes with a multiplier effect.

2 Claims, 4 Drawing Sheets

METHOD OF PLAYING A BOWLING GAME

BACKGROUND OF THE INVENTION

1. Field of the Invention

This invention relates to the field of the sport of bowling, and more particularly to a method of playing a bowling game.

2. Description of the Related Art

As can be seen by reference to the following U.S. Pat. Nos. 4,597,575; 4,817,947, 4,884,806, and 5,582,549 the prior art is replete with myriad and diverse methods of playing a bowling game. U.S. Pat. No. 4,597,575 appears to disclose a variation of a scoring system that awards points for pins left standing, not pins knocked down. The one with the lowest score wins the game. It seems that this system is designed for more inexperienced players rather than professional bowling players. U.S. Pat. No. 4,817,947 also is a variation of scoring bowling that proposes various placements of the pins, depending on the levels of skill each player has. It appears to apply to a luck factor much more than actual skill so that people of widely varied skills can compete with more of an equal chance of success. U.S. Pat. No. 4,884,806 also discloses a varied system of scoring for bowling that scores according to given trajectories set forth on the bowling lane that the bowler tries to duplicate with the path of their ball. This method awards points more for the accuracy the player can duplicate throwing the ball for their pre-designated trajectory formed on the bowling lane. U.S. Pat. No. 4,930,775 is also a similar method of scoring in terms of skill, rather than luck. It has a minimum requirement of pins to be knocked down with each throw of the ball; it eliminates a pin from the pin set up with each consecutive frame; and any player who delivers a gutter ball is eliminated from the game. U.S. Pat. No. 5,582,549 appears to be a scoring system that increases the "luck/chance" factor in winning and not skill. It uses standard regulatory scoring with the exception that it also has "penalty" frames whereby the bowler loses points for pins knocked down. The more skill and experience a player has the more "penalty" frames they have to play; the less skilled, the less "penalty" frames the player has to play making this game all around a "luck" factor game. It is clear that all the prior art have variations on scoring the game but it appears that none of them are structured in a way to make this a 100% skill based game.

While all of the aforementioned prior art methods are more than adequate for the basic purpose for which they have been specifically designed, they are uniformly deficient with respect to their failure to provide a simple, efficient, practical and fair method of scoring a bowling game which fairly represents the skills of the players.

At present the current conventional method employed in scoring bowling does not necessarily mean that the best bowler of the tournament won the event. The "luck factor" seems to be the combination of strikes and spares, and the bowler with the most strikes and spares may not win the match because of the combination of those strikes and spares.

As a consequence of the foregoing situation, there has existed a need for a new and improved method of playing a bowling game and the provision of such a method is a stated objective of the present invention.

BRIEF SUMMARY OF THE INVENTION

Briefly stated, the present invention provides a method of playing a bowling game wherein players are allowed at least one ball in each of twelve frames. If the player has a predetermined minimum pin count with the first ball in a frame, they are awarded another ball to complete the spare. If the player has fewer than the predetermined minimum pin count with the first ball in a frame, the pin count is scored and the player goes to the next frame. This method of scoring eliminates the unfair advantage of scoring consecutive strikes with a multiplier effect.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
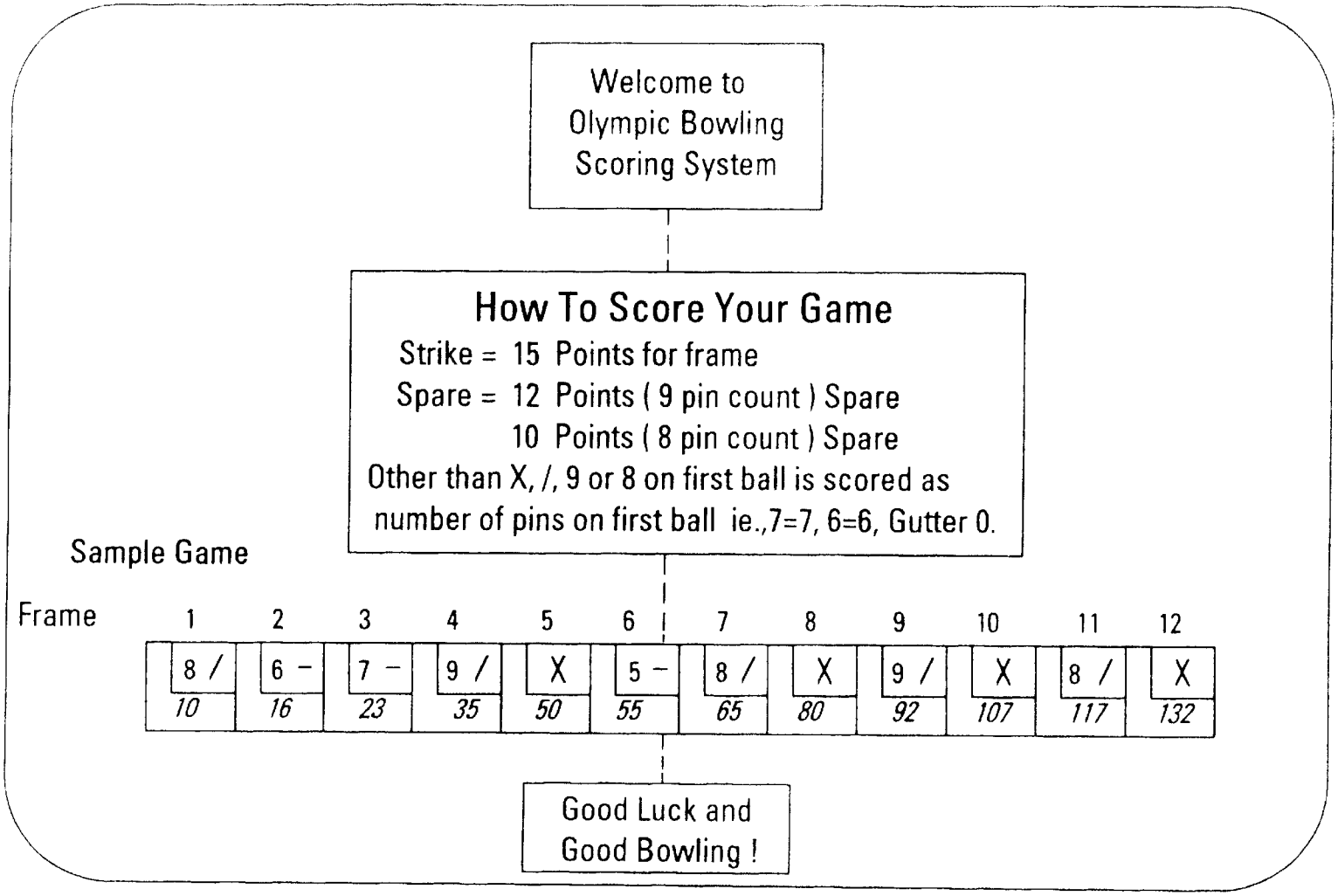
FIG. 1 is a bowling game score sheet and scoring instructions to be used in scoring the bowling game using the method of the present invention.
Figure 2:
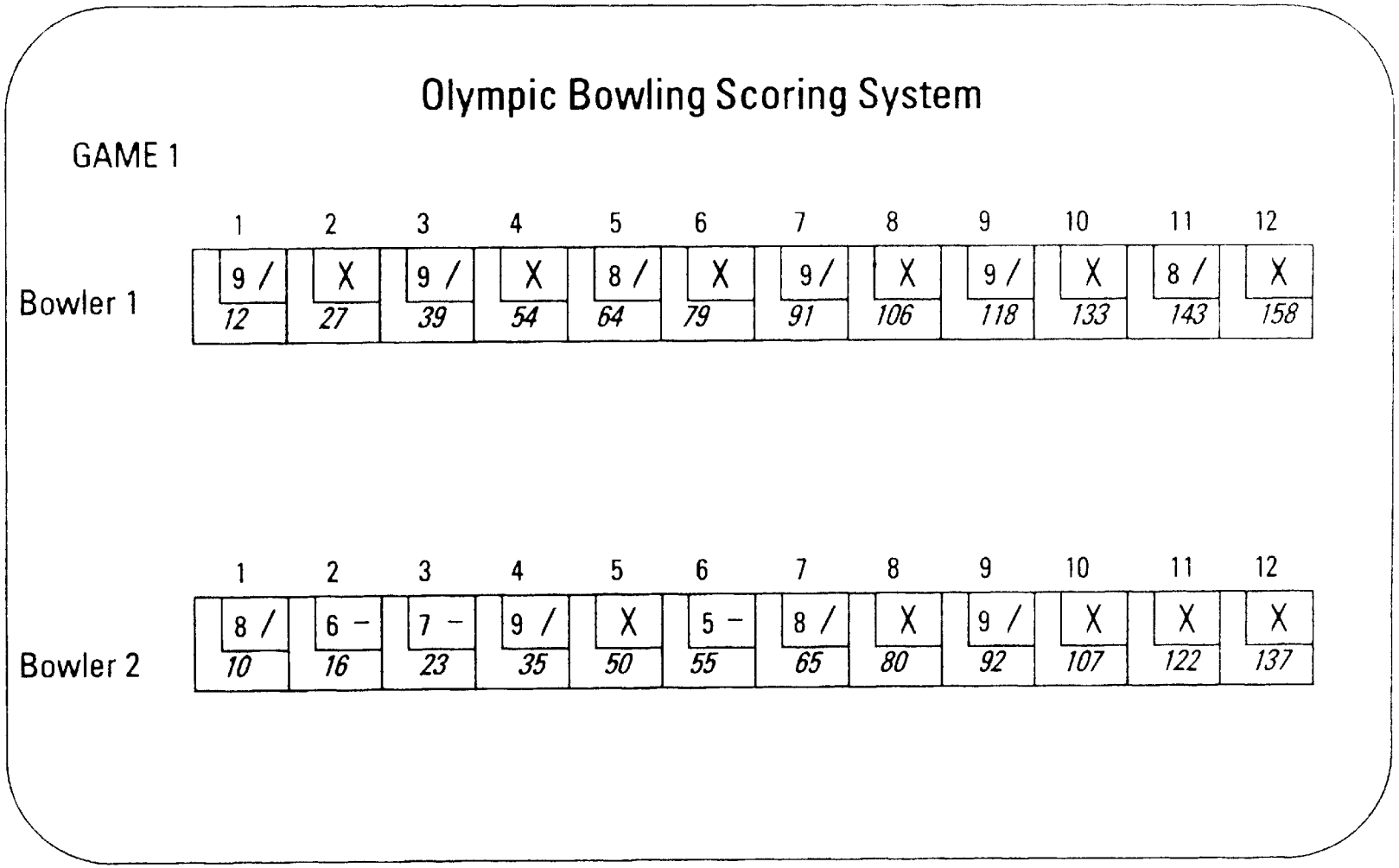
FIG. 2 is a bowling game score sheet for two bowlers.
Figure 3:
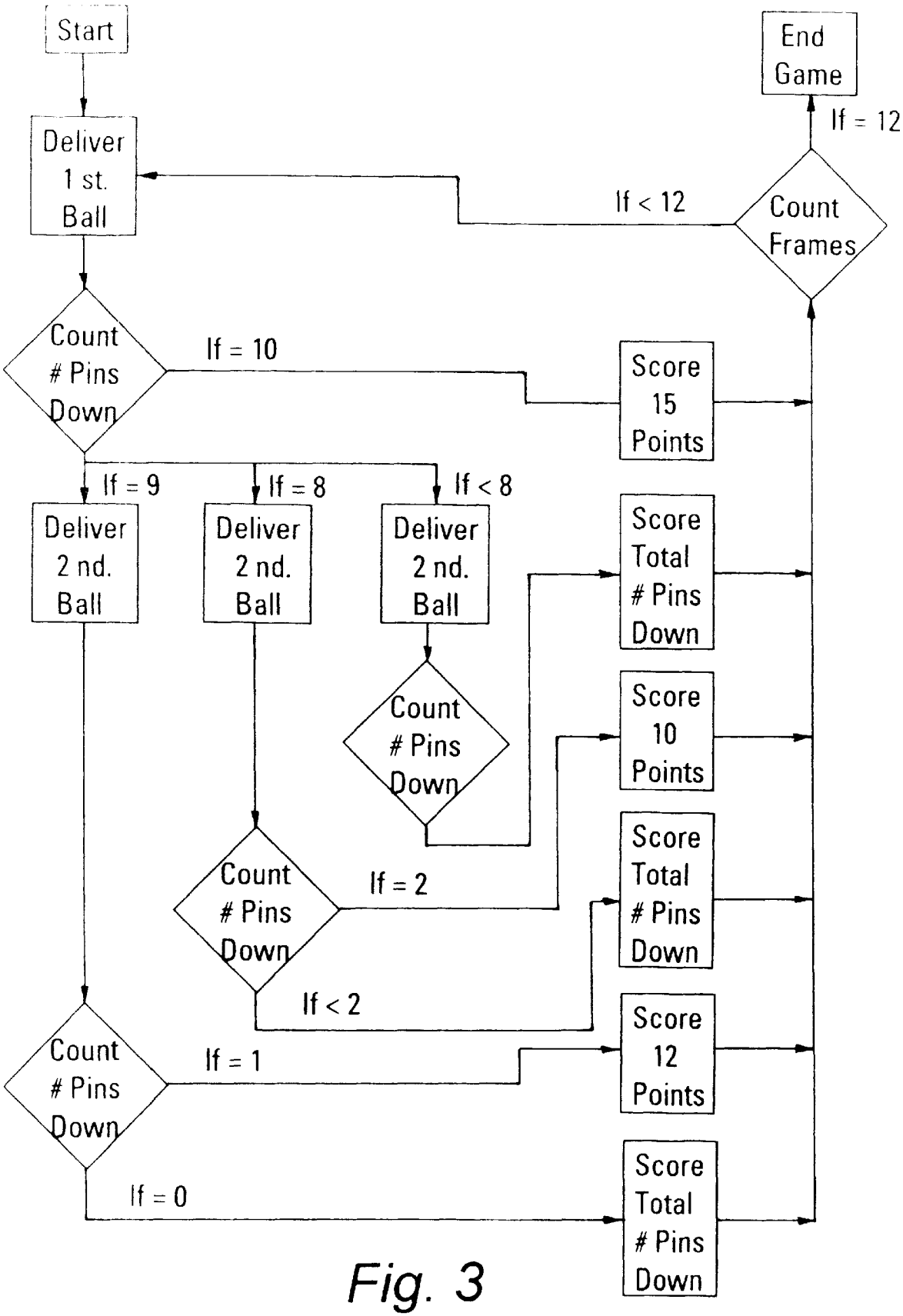
FIG. 3 is a flow chart illustrating the method of playing a bowling game of the present invention.
Figure 4:
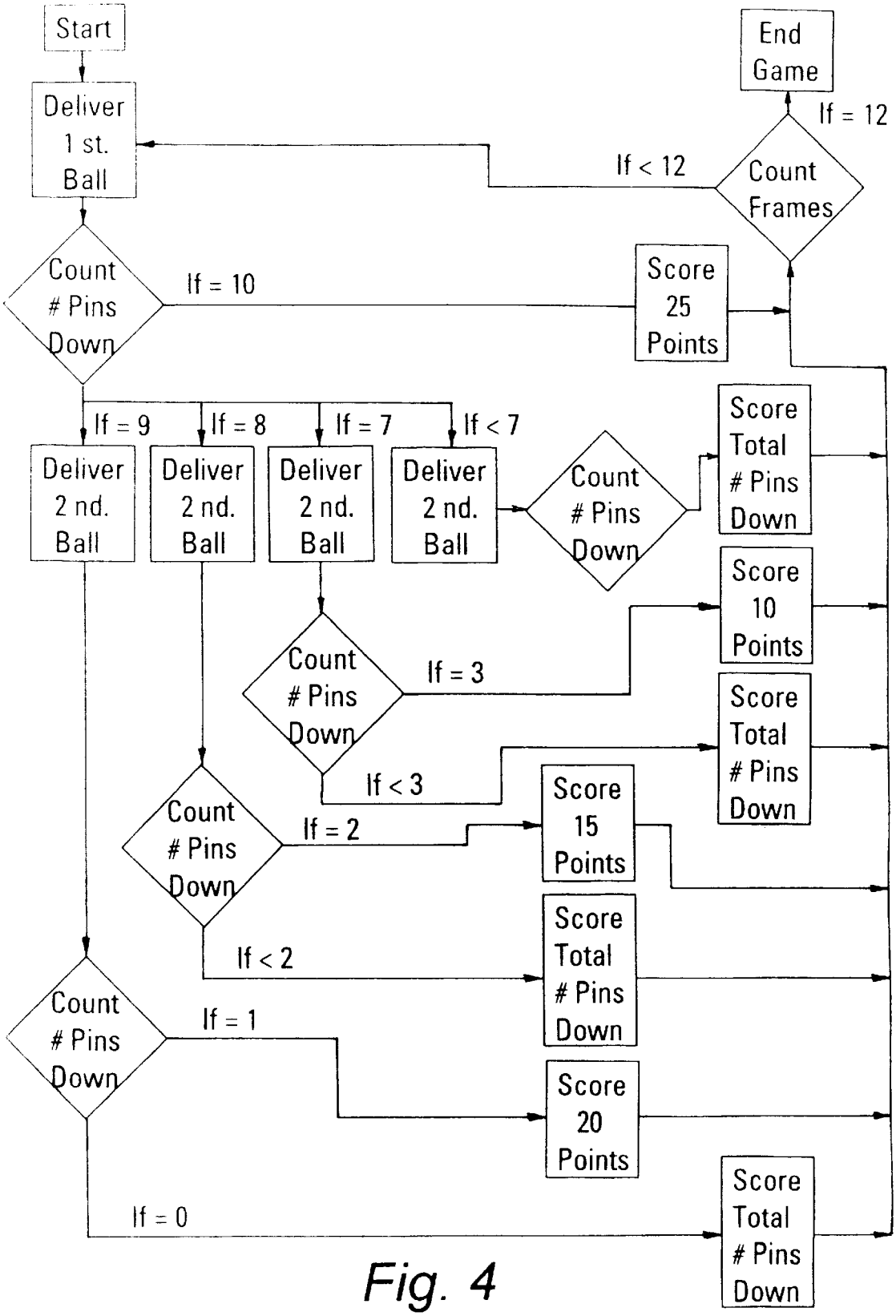
FIG. 4 is a flow chart illustrating an alternate method of playing a bowling game.

As can be seen by reference to the drawings, and in particularly to FIG. 1, the method of playing a bowling game that forms the basis of the present invention is described and includes scoring for a sample game. FIG. 2 shows a scoring sheet for two bowlers.

Bowling is a great game, but too much luck is involved. The question is how to get rid of the majority of luck and keep the game intact. Keeping the game intact means strikes and spares in other words, good shots, is the objective. To attack this problem one needs to ask where does the majority of luck come from? It is estimated that a well thrown ball will strike approximately 75–80% of the time when delivered in the pocket. It is also estimated there will be approximately 10% lucky strikes in the course of tournament. That means these two things being pretty much universal for everybody over the course of a tournament are not a problem. If the bowler at the end of the week with the most strikes and spares will win every time, this is a positive for bowling. That is what the scoring method of the present invention is intended to accomplish.

Since good strikes and lucky strikes equal out for most bowlers, the huge luck factor comes in the scoring of the games, not in the game itself. To award differently for the order of which these things are done, instead of how consistently they are done increases the luck factor dramatically. If the bowler who made the most good shots is to win at the end of the week, the method of scoring has to be changed. The method of the present invention provides a solution while keeping the great game intact. The order of things must be made less important than the consistency of things. The scoring system of the present invention will accomplish this goal.

With this scoring system the number of frames can be any amount; as most computers are set up to handle 12 frames at present. Keep in mind that this method of scoring is designed to eliminate as much luck as possible.

As illustrated in FIGS. 1 and 2, the "Olympic bowling scoring system" is a new method for scoring bowling games.

It is to be produced in computerized format for use in bowling halls. The purpose of this is to reduce the "luck factor" and reward a bowler on the basis of consistency of throwing strikes and spares.

While all the prior art disclose various methods for scoring a bowling game, none of them disclose the following:

1. Strikes are worth 15 points.
2. Spares are worth 10 or 12 points depending on the following:
   (A) 9 pin count on the first ball is worth 12 points
   (B) 8 pin count on the first ball is worth 10 points
   (C) A pin count less than 8 on the first ball is scored as the number of pins knocked down and score appropriately from 0 through 7 pins.
3. The only time you get two balls in a frame is if you have 8 or 9 points thrown with the first ball.
4. There is no penalty for splits, because splits some time do occur with a good pocket shot. This allows the bowler to still get points for the number of pins they have knocked down.
5. The scoring system eliminates the unfair advantage of stringing strikes together and not doing well in other frames.
6. No players get knocked out of the game because an opponent may score a triple or quad set of strikes in the beginning of the game.

With this scoring system, all bowlers have 12 shots per game, for 18 games or 216 shots at rolling a strike. The number of spares that are shot will vary on how well the first shot was delivered. This specific feature of this scoring system makes the game much more a skill based game than luck based.

A winner at the end of the tournament will know that they won the tournament because they had the best and most consistent shots throughout the tournament.

It can be made available on computerized format as all bowling halls are now computerized. The screen format is shown in FIGS. 1 and 2.

It is believed that this scoring system will make it much easier for beginners to learn the game, because standard regulation bowling scores are often complex and do not fairly represent the skills of the players.

When considering the 8 and 9 pin count rule for a chance to shoot a spare, many things come to mind.

1. It puts great emphasis on the first ball, which is where it should be since every bowler will have thrown an equal number of first balls down the lane.
2. This eliminates the super punishment of the split and/or washout. For example: A well placed ball can produce a pocket split. Good shot, but just didn't turn out well. In other words a bad break.

If the goal is to make luck the smallest part of the outcome as possible, the bowler who "flags the headpin" should not get a better score for that frame than the bowler who hit the pocket and got a bad break. Compounding the score for stringing strikes together gives an unfair result. The greatest amount of luck can be eliminated in this area, because this is the area where the bowler is rewarded for the order of strikes instead of the consistency of strikes. To prove this point a final game score of 250 to 200 is a 25% advantage to the winner. A bowler who leaves a solid 10 pin and spares then strikes while his opponent turkeys (3 strikes in a row) is behind 33% in the first frame. It is clearly unfair that 3 strikes against spare-strike should be worth more than a 250-200 final score.

The lucky strike, which cannot be compensated for, should not be compounded, since the goal is to eliminate luck not to make it greater. There are more examples of the rewarding for the order of things versus the consistency of things, like 2 bonus frames in the 10th frame, etc. To eliminate the luck factor the scoring must emphasize how many good shots not when, and how consistent the good shots, where.

An unfair scoring system has an effect on the bowlers themselves. Any athlete competing in a game of skill likes to think they have the exact same chance as their opponents have. In bowling today in an 18 game tournament format to qualify, it is possible for a bowler to have 36 more chances at the game's highest reward, the strike, than some of their opponents, simply by doubling in the 10th frame. To put this in perspective, it's the same as 3 more games. This is another example of the old nemesis of when and where instead of how often. It is no wonder bowlers become frustrated so early in the game. Sometimes a couple of bad breaks or bad shots while their opponent throws the first 4 strikes, then they're blown out of the game. A scoring system which rewards and records each shot the same from beginning to end, would keep the bowler in the game from beginning to end. With a scoring system void of the huge luck factor of when and where, the bowler knows going into the game they are going to have the exact same number of chances at the strike, in other words the game's highest reward as their opponents have. They also know if their first shots were all good, they will probably have more chances for the games second highest reward, a spare, than their opponents. This fact will keep a bowler's will and desire to make their best shot each and every shot going throughout the tournament.

With this scoring system, all bowlers would have 12 shots a game for 18 games or 216 shots at the strike. The number of spares they shoot will also depend on how well they throw those 216 shots. A winner at the end of the tournament will know absolutely and without question that they made the best and the most consistent good shots in the tournament. This is what the goal of the tournament should be.

A scoring system for any game of skill should never reduce the skill factor by increasing the luck factor. This scoring system simply rewards good shots from the beginning of a tournament until the end of the tournament.

An alternate scoring system keeps the 300 game intact by making the best shot you can make, a strike, worth 25 points. Twenty-five points for 12 frames would result in a 300 game. Spares will only be shot if the bowler gets 7, 8 or 9 on the first ball. The alternate scoring system would also provide a direct relationship between the score and the player's proficiency level, as illustrated in Table 1.

TABLE I

| Scoring Code | Proficiency Level |
|---|---|
| x-strike = 25 | 100% |
| 9-spare = 20 | 80% |
| 8-spare = 15 | 60% |
| 7-spare = 10 | 40% |
| 6 = 6 | 24% |
| 5 = 5 | 20% |
| 4 = 4 | 16% |
| 3 = 3 | 12% |
| 2 = 2 | 8% |
| 1 = 1 | 4% |
| 0 = 0 | 0% |

These percentages follow through from the first frame of the first game to the last frame of the tournament.

A scoring method of any game or contest should be to measure the level of proficiency of the contestants. This method will accomplish exactly that.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A method of playing a bowling game in which players are allowed at least one ball to knock down pins in each of a plurality of twelve frames, the method consisting of:

allowing each player to deliver at least a first ball in each of the frames;

counting the number of pins knocked down by the first ball in each frame;

allowing each player to deliver a second ball in each of the frames two or fewer pins remain standing after the ball is;

counting the number of pins knocked down by the second ball in each frame; and scoring each frame individually by awarding 15 points for knocking down all pins with the first ball, 12 points for knocking down all pins with the second ball where one pin remains standing after the first ball, 10 points for knocking down all pins with the second ball where two pins remain standing after the first ball, and 0 points to 9 points for knocking down a corresponding number of 0 to 9 pins with the first and second balls wherein some pins remain standing.

2. A method of playing a bowling game in which players are allowed at least one ball to knock down pins in each of a plurality of twelve frames, the method consisting of:

allowing each player to deliver at least a first ball in each of the frames;

counting the number of pins knocked down by the first ball in each frame;

allowing each player to deliver a second ball in each of the frames;

counting the number of pins knocked down by the second ball in each frame; and scoring each frame individually by awarding 25 points for knocking down all pins with the first ball, 20 points for knocking down all pins with the second ball where one pin remains standing after the first ball, 15 points for knocking down all pins with the second ball where two pins remain standing after the first ball, 10 points for knocking down all pins with the second ball where three pins remain standing after the first ball, and 0 points to 9 points for knocking down a corresponding number of 0 to 9 pins with the first and second balls wherein some pins remain standing.

* * * * *